US010876383B2

(12) United States Patent
Nandola et al.

(10) Patent No.: US 10,876,383 B2
(45) Date of Patent: Dec. 29, 2020

(54) METHOD AND SYSTEM FOR MAXIMIZING PRODUCTION OF A WELL WITH A GAS ASSISTED PLUNGER LIFT

(71) Applicant: ABB Schweiz AG, Baden (CH)

(72) Inventors: Nareshkumar Nandola, Bangalore (IN); Niket Kaisare, Bangalore (IN); Arun Gupta, Mumbai (IN)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 15/531,279

(22) PCT Filed: Nov. 30, 2015

(86) PCT No.: PCT/IB2015/059197
§ 371 (c)(1),
(2) Date: May 26, 2017

(87) PCT Pub. No.: WO2016/084054
PCT Pub. Date: Jun. 2, 2016

(65) Prior Publication Data

US 2017/0356278 A1 Dec. 14, 2017

(30) Foreign Application Priority Data

Nov. 30, 2014 (IN) ..... 5994/CHE/2014

(51) Int. Cl.
*E21B 43/12* (2006.01)
*E21B 34/16* (2006.01)
(Continued)

(52) U.S. Cl.
CPC ..... *E21B 43/128* (2013.01); *E21B 34/06* (2013.01); *E21B 41/0092* (2013.01);
(Continued)

(58) Field of Classification Search
CPC ..... E21B 41/0092; E21B 43/12; E21B 44/00
See application file for complete search history.

(56) References Cited

U.S. PATENT DOCUMENTS 4,738,313 A 4/1988 McKee
4,921,048 A 5/1990 Crow et al.
(Continued)

FOREIGN PATENT DOCUMENTS

CN 2621219 Y 6/2004
CN 203685148 U 7/2014
(Continued)

OTHER PUBLICATIONS

European Patent Office, International Search Report for PCT/IB2015/059197, dated May 2, 2016, 3 pages.
(Continued)

*Primary Examiner* — Blake E Michener
*Assistant Examiner* — Theodore N Yao
(74) *Attorney, Agent, or Firm* — Barnes & Thornburg LLP

(57) ABSTRACT

The invention provides a method and system for maximizing production of a well with a gas assisted plunger lift. The method comprises obtaining a plurality of measurements associated with operation of the well from sensors associated with various components of the well. The method further comprises determining set points for operation of the production valve and the injection valve based on one or more of the plurality of measurements. The set points may be determined by the controller or by a SCADA system. Optionally, one or more of the set points may be modified according to a comparison of current and optimal values of plunger velocity and gas and liquid production. In addition, the method comprises coordinating the operation of the production valve and the injection valve is coordinated
(Continued)

based on the set points and the stage in operation cycle by the controller.

18 Claims, 6 Drawing Sheets

(51) Int. Cl.

| | |
|---|---|
| ***E21B 43/16*** | (2006.01) |
| ***E21B 47/06*** | (2012.01) |
| ***E21B 34/06*** | (2006.01) |
| ***E21B 41/00*** | (2006.01) |
| ***E21B 47/04*** | (2012.01) |
| *E21B 12/00* | (2006.01) |
| *E21B 44/00* | (2006.01) |

(52) U.S. Cl.
CPC ..... *E21B 43/122* (2013.01); *E21B 43/168* (2013.01); *E21B 47/04* (2013.01); *E21B 47/06* (2013.01); *E21B 12/00* (2013.01); *E21B 44/00* (2013.01)

(56) References Cited

U.S. PATENT DOCUMENTS

| | | | | |
|---|---|---|---|---|
| 5,634,522 | A | 6/1997 | Hershberger | |
| 5,785,123 | A | 7/1998 | Lea, Jr. | |
| 5,871,048 | A | 2/1999 | Tokar et al. | |
| 6,241,014 | B1 | 6/2001 | Majek et al. | |
| 7,681,641 | B2 * | 3/2010 | Mudry | E21B 43/121 166/250.15 |
| 9,695,680 | B2 * | 7/2017 | Bergman | E21B 43/121 |
| 2002/0029883 | A1 | 3/2002 | Vinegar et al. | |
| 2002/0074118 | A1 * | 6/2002 | Fisher | E21B 43/12 166/250.15 |
| 2003/0121656 | A1 * | 7/2003 | Hershberger | E21B 43/12 166/250.03 |
| 2003/0145986 | A1 | 8/2003 | Evans et al. | |
| 2005/0022998 | A1 * | 2/2005 | Rogers, Jr. | E21B 43/129 166/372 |
| 2007/0012442 | A1 | 1/2007 | Hearn | |
| 2008/0154564 | A1 | 6/2008 | Rashid et al. | |
| 2009/0200020 | A1 * | 8/2009 | Hearn | E21B 43/121 166/250.01 |
| 2010/0051267 | A1 * | 3/2010 | Lowe | E21B 43/122 166/250.15 |
| 2013/0071262 | A1 * | 3/2013 | Green | E21B 43/122 417/65 |
| 2015/0136389 | A1 * | 5/2015 | Bergman | E21B 43/121 166/250.15 |
| 2017/0009558 | A1 * | 1/2017 | Wong | E21B 43/00 |

FOREIGN PATENT DOCUMENTS

| | | | |
|---|---|---|---|
| EP | 0756065 | A1 | 1/1997 |
| EP | 1028227 | A1 | 8/2000 |
| WO | 00/00715 | A1 | 1/2000 |
| WO | 2013/188090 | A1 | 12/2013 |

OTHER PUBLICATIONS

European Patent Office, Written Opinion of the International Searching Authority for PCT/IB2015/059197, dated May 2, 2016, 6 pages.
European Patent Office, International Preliminary Report on Patentability for PCT/IB2015/059197, dated Jun. 6, 2017, 7 pages.

* cited by examiner

| Threshold Pressure | Foss and Gaul | Slug Correction | Friction Correction | Gas Assist Correction |
|---|---|---|---|---|
| 373 | 422 | ☑ 32 | ☑ -16 | ☑ -65 |

FIG. 6

METHOD AND SYSTEM FOR MAXIMIZING PRODUCTION OF A WELL WITH A GAS ASSISTED PLUNGER LIFT

CROSS-REFERENCE TO RELATED APPLICATIONS

This application is a U.S. national stage of International Application Serial No. PCT/IB2015/059197, filed Nov. 30, 2015, which claims priority to Indian Patent Application No. 5994/CHE/2014, filed Nov. 30, 2014. The entire disclosures of both of the foregoing applications are hereby incorporated by reference.

FIELD OF THE INVENTION

The present invention relates generally to maximizing production of hydrocarbon or fossil fuel wells having gas assisted plunger lifts.

BACKGROUND OF THE INVENTION

A hydrocarbon well consists of an inner tube called tubing and an outer tube called casing. The region between the two is called annulus. When the reservoir conditions and well structure are proper, the well flows due to its natural pressure. However, with change in the conditions or to enhance efficiency, an artificial lift is required for lifting liquids from the well.

Common artificial lift methods include plunger lift, gas lift, downhole pumps like Electrical Submersible Pumps (ESP), and well head pumps like rod pumps etc. The appropriate artificial lift method is selected based on the reservoir conditions and well structure. A hybrid lift mechanism may also be used. Such a method employs more than one lift principle in order to deliquefy the hydrocarbon well. Gas-Assisted Plunger Lift (GAPL) is an example of one such technique, which introduces gas lift within plunger lift to improve its performance.

In a GAPL, a gas is injected in the annulus to assist the plunger in lifting the liquids from the well bottom to the surface. GAPL is variously known as "intermittent gas lift with plunger" or "plunger-assist", indicating that another way to look at GAPL is that it is an intermittent gas lift process with a plunger used to deliquefy the well more efficiently.

At the start of a production cycle, the production valve of the well is closed and the plunger falls down to the bottom of the well due to gravity. During plunger fall and pressurization stages, the casing and tubing pressures increase (casing pressure generally increases faster than tubing pressure). The well is kept closed for a pre-determined amount of time, so that sufficient pressure builds up in the annulus. When the production valve is opened, the gas above the plunger starts flowing, tubing pressure drops rapidly and the higher pressure at the bottom of the plunger causes the plunger to rise through the tubing with liquid slug above it. After the plunger surfaces at the well-head, it is held in a catcher/lubricator and the well is allowed to flow. In this after-flow stage, the pressure in the tubing as well as the casing falls. The energy accumulated in the annulus is primarily responsible to lift the plunger to the surface. The injection valve can be opened anytime during the cycle, injecting gas in the casing to supplement the casing pressure.

The decision to open/close the production valve primarily controls the plunger lift part of GAPL (specifically, plunger cycling). Current industrial practice for production valve opening and closing is pre-decided for retaining the valve in either open or closed state. Some methods determine valve open condition based on pressure, and valve close condition based on flow-rate. Methods of controlling the production valve opening based on plunger arrival time are presented in U.S. Pat. Nos. 5,785,123 and 6,241,014. Methods to determine production valve closing conditions are presented in US patent applications US 2007/0012442 A1, US 2009/0200020 A1 and U.S. Pat. No. 6,883,606.

However, the abovementioned methods are targeted towards plunger lift; and are incomplete and/or inapplicable for the GAPL operation as they do not consider the effect of injection gas. In some control methods, such as US patent application US 2013/0071262 A1, the gas injection is primarily for plunger assist. A predetermined quantity of gas is injected in the well for a predetermined amount of time; and this amount is varied manually based on slow/fast plunger arrival.

The decisions on injection valve opening (or injection flow rate and time) controls the gas lift part of GAPL. While methods of injection of lift gas, optimization of gas lift production, gas lift control are generally known, these are not directly relevant to GAPL. This is because gas lift is typically a continuous process, whereas GAPL (like plunger lift) is a cyclic/periodic process. Thus adaptive or model-based control ideas from gas lift are not applicable to GAPL.

Typically, the operation criteria is selected in an ad-hoc manner for a feasible operation of the GAPL system. The operation of such a hybrid system demands a multivariate control strategy with both production and injection valve operation in a coordinated manner. The current practices of GAPL operation do not account for interaction between injection and production valves. The operation is assumed to be working in a feasible manner not accounting for maximizing gas/oil production and non-reactive to well disturbances like injection or line pressure. The ad-hoc settings for well operation may work for some time and requires constant attention of well operators to avoid extended shut-ins or extra gas injection.

In view of the above, there exists a need for a method for multivariable control of GAPL system which considers both injection and production valve operation condition in a coordinated manner. Also, the control should be able to predict and react to surface and reservoir conditions in real time for determining optimal valve open and close conditions.

SUMMARY OF THE INVENTION

The invention provides a method and system for maximizing production of a well such as a hydrocarbon or fossil fuel well. The well comprises a casing connected to a gas injection line, a tubing connected to a sales line, a production valve for controlling supply to the sales line, an injection valve for controlling injection of gas from the gas injection line into the casing, and a plunger for assisting in lifting of one or more of a liquid and a gas in the well. Here, the plunger operation is assisted by the injection of gas through the injection valve.

The method comprises obtaining at a controller of the well, a plurality of measurements associated with operation of one or more of the production valve, the injection valve, the gas injection line, the sales line, the casing, the tubing and the plunger.

The method further comprises determining a set point for opening of the production valve after closing of the production valve, a set point for operating the injection valve during the period when the production valve is closed, a set point for operating the injection valve during the period when the production valve is open and a set point for closing of the production valve after opening of the production valve. The determination of one or more of the set points mentioned above is performed at one of the controller and a Supervisory Control And Data Acquisition (SCADA) system associated with the controller.

The set point for opening of the production valve is determined based on at least one measurement of the plurality of measurements associated with injection of gas through the injection valve and at least one measurement of the plurality of measurements associated with the operation of at least one of the casing, the tubing, the sale line, and the plunger. For example, the set point for opening the production valve may be determined based on a measurement of pressure in the casing and an estimate of an amount of gas injection through the injection valve, wherein the estimate is based on a measurement of flow rate of the gas through the injection valve and a time of arrival of the plunger. Also, the determination of the set point may be based on measurement related to a current or the last few cycles.

The set point for operating the injection valve during the period when the production valve is closed is determined based on the plurality of measurements associated with the operation of the casing, the tubing and the plunger. For example, the set point for operating the injection valve may be determined based on a comparison of an estimate of a rate of change of pressure in the casing with an estimate of a rate of change of pressure in the tubing, wherein said estimates are based on the plurality of measurements associated with the operation of the injection valve. Also, the determination of the set point may consider a history of measurements such as of a day or two or more.

The set point for operating the injection valve during the period when the production valve is open based on the plurality of measurements associated with the operation of the sales line and the plunger. For example, the set point for operating the injection valve may be determined based on an estimate of the amount of gas injection during plunger rise, wherein the estimate is based on the plurality of measurements associated with operation of the injection valve. Also, the determination of the set point may consider a history of measurements such as of a day or two or more.

The set point for closing of the production valve is determined based on at least one measurement of the plurality of measurements associated with the operation of the casing, the tubing and the sales line. For example, the set point for closing of the production valve may be determined based on a measurement of pressure of the tubing and the sales line. Also, the determination of the set point may be based on measurement related to a current or the last few cycles.

The method further comprises coordinating, by the controller, the operation of the production valve and the injection valve based on one or more of said determinations and a corresponding stage in an operation cycle of the well, wherein the operation cycle starts and ends with closing of the production valve and comprises the stages of plunger fall, build up, plunger rise and after flow.

The method may also comprise modifying at least one of the set point of opening the production valve, the set point for operating the injection valve during the period the production valve is opened, the set point for closing the production valve and the set point for operating the injection valve during the period the production valve is closed. Such modification may be based on a comparison of a measurement of plunger velocity and gas and liquid production with corresponding optimal values.

The system comprises a plurality of sensors for collecting the plurality of measurements associated with operation of one or more of the production valve, the injection valve, the gas injection line, the sales line, the casing, the tubing and the plunger. The system also comprises the controller, which coordinates operation of the production valve and the injection valve in the operation cycle according to the corresponding set points. The controller can communicate with the SCADA system for one or more of obtaining the plurality of measurements and determining one or more of the set points.

BRIEF DESCRIPTION OF DRAWINGS

The subject matter of the invention will be explained in more detail in the following text with reference to exemplary embodiments which are illustrated in attached drawings in which:

FIG. 6 illustrates a tabular display that can be used to choose correction.

DETAILED DESCRIPTION

The invention relates to maximizing production of a well such as a hydrocarbon or a fossil fuel well.

Figure 1:
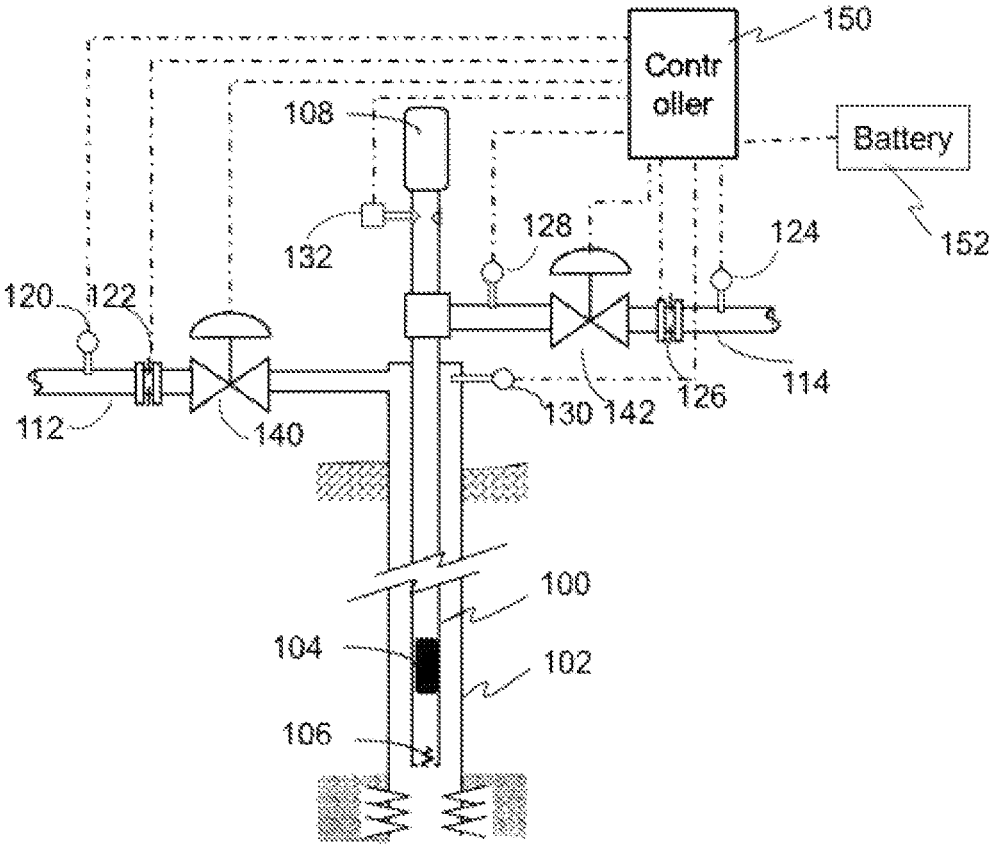
FIG. 1 illustrates a well with a gas assisted plunger lift.

FIG. 1 illustrates a well with a Gas Assisted Plunger Lift (GAPL). The well has an outer tube called casing (102), which is connected to an injection line (112); and an inner tube called tubing (100), which is connected to a sales line (114). The well also has a production valve (142) that can be opened or closed to allow the well to flow or shut-in; and an injection valve (140) that can be opened at specified percent to allow the gas to flow from injection to casing.

In addition, a plunger (104) is provided that can move up or down the tubing. When the production valve is opened, the plunger is intended to eventually come to rest in a catcher/lubricator (108) located at the well-head. When the production valve is closed, the plunger falls and eventually comes to rest at the bottom seat (106).

A controller (150) is provided to collect measurements, determine control actions and communicate data with a central control and data system. A battery (152) is used to power the controller. The battery may also be connected to a solar panel (not shown). The controller may be connected to one or more sensors such as, but not limited to, sensors for measuring casing pressure (130); tubing pressure (128); line pressure (124); flow rate (126); arrival of the plunger in the catcher and record the arrival time (132), injection pressure (120); and injection flow rate (122).

Figure 2:
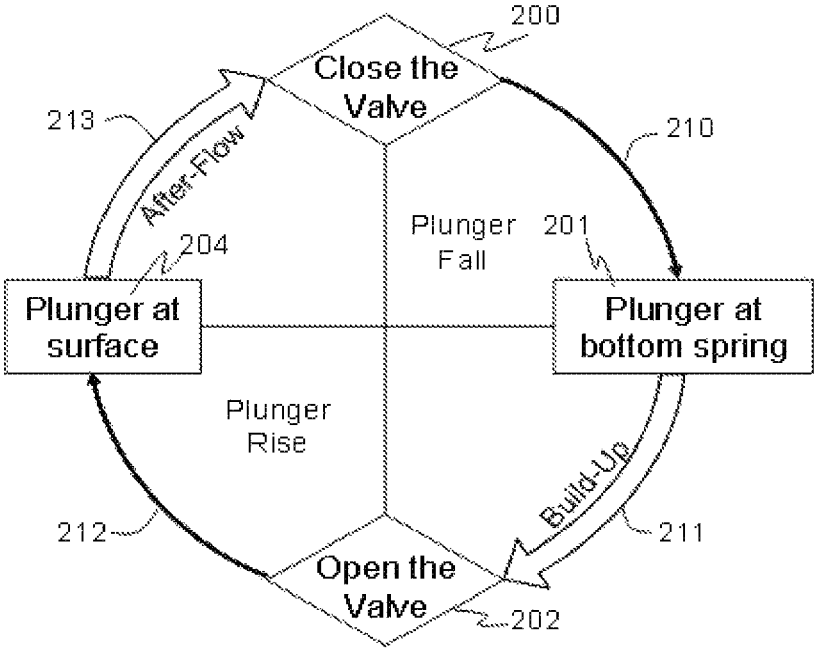
FIG. 2 illustrates a plunger lift cycle without gas assist.

Referring now to FIG. 2, which illustrates a plunger lift cycle without gas assist. At a certain point, an operator or the controller decides to close the production valve (indicated by 200). The new cycle now starts as the production valve is put in the closed position. The plunger starts to fall from the catcher towards the well bottom. It takes some amount of time to reach the bottom spring (indicated by block 201). This stage is called "plunger fall" stage (210).

Once the plunger is at the bottom spring, it stays there as long as the well is shut-in. The valve is kept shut for additional "build-up" time (stage 211). In the total amount of time of shut-in (210 as well as 211), the tubing and casing pressures increase. Often (but not always), the casing pressure rises faster than tubing pressure.

After the build-up period, the production valve is opened (202). With the production valve open, gas starts to flow and the plunger rises with the liquid slug ("plunger rise" stage, 212). The plunger then arrives at the surface (represented by block 204). The time taken for plunger to reach the surface after the valve is opened is measured and recorded. This is called the plunger arrival time.

The well is allowed to keep flowing and produce hydrocarbons for an additional period of time, called "after-flow" stage (indicated by 213), during which the plunger remains at the surface (in catcher/lubricator). Thereafter, the production valve is closed again, and the cycle is repeated. The above description is for a plunger lift cycle without assistance from gas lift.

Figure 3:
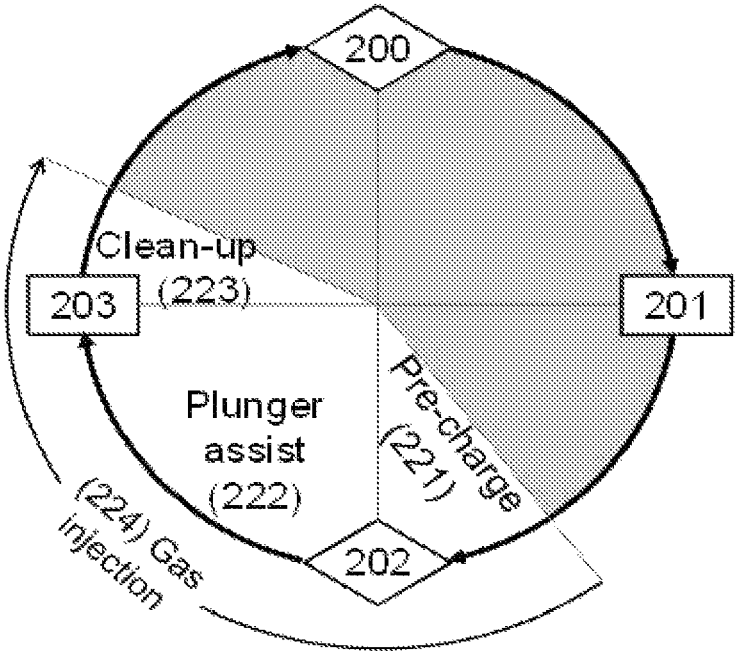
FIG. 3 illustrates a Gas Assisted Plunger Lift (GAPL) cycle.

FIG. 3 is a representation of a GAPL cycle. The intention of gas injection is to assist the plunger to arrive at the surface more efficiently, with the liquid slug on top of it. In this operation, no gas is injected during the plunger fall stage (between 200 and 201). Gas injection may start during the build-up stage. This gas injection is called "pre-charge" (221). Note that pre-charging is optional. Pre-charging may start at block 201 (i.e., as soon as the plunger reaches the well bottom) or thereafter.

The primary aim of improving the plunger cycle is achieved by injecting the gas during plunger rise stage. This gas injection is called "plunger assist" (222). After the plunger reaches the surface (203), the gas injection may be continued for a further amount of time with the plunger held at the surface. This stage of gas injection is called "clean-up" (223). Clean-up is optional, and may last for the entire duration that the production valve is open.

The various decisions to be made in a GAPL operation are the following: (i) decisions to open and close the production valve (represented by 200 and 202); and (ii) time and amount of injection (represented by 224). Thus, the objectives in a GAPL operation include (i) maximize the net production of hydrocarbons (or net profit); and (ii) ensure plunger arrival within the designed limits, and (iii) minimize costs, i.e. gas injection. The cyclic behavior of this process present a challenge(s) in controlling the process.

The well may not have sufficient reservoir energy or sufficient amount of gas to operate on plunger lift alone. So, gas lift assists in ensuring plunger cycling. With this view in mind, the control strategy proposed in this invention uses production valve open/close manipulation to maximize the net production/profit, and injection valve manipulation to ensure normal plunger arrival. Additionally, the invention accounts for the fact that the injected gas affects net production/profit, and duration of shut-in/flowing times affect plunger arrival times.

Figure 4:
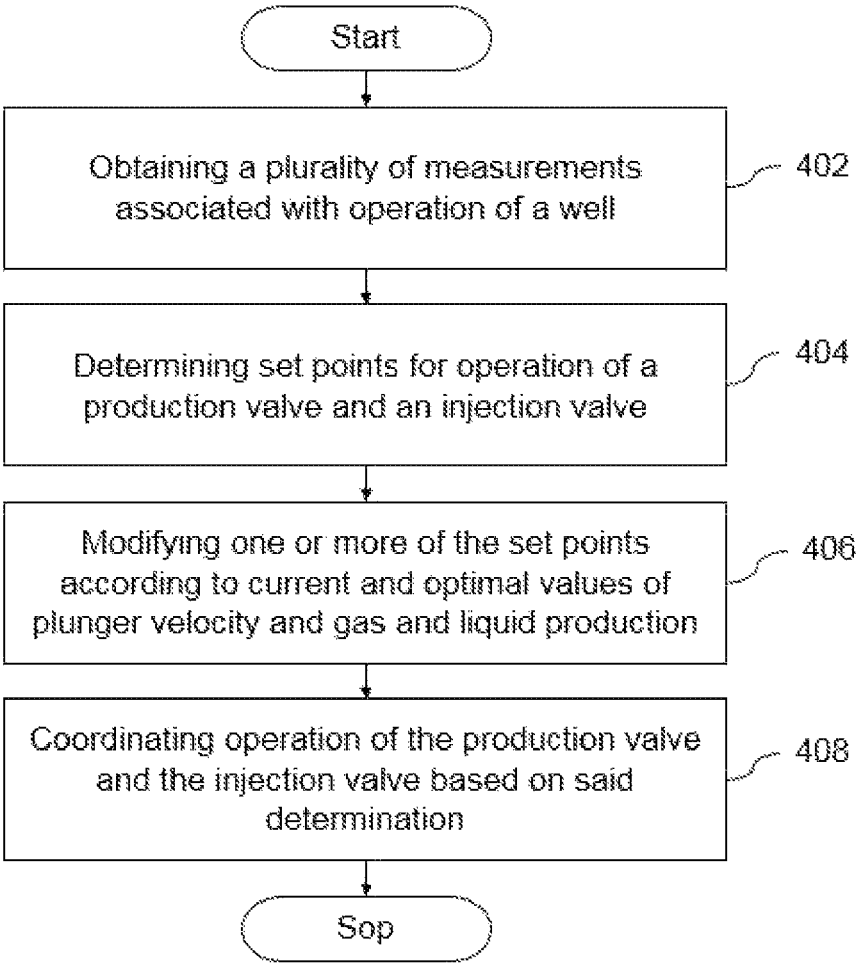
FIG. 4 is a flowchart of a method for maximizing production of the well.

Moving to FIG. 4, which is a flowchart of a method for maximizing production of the well. At 402, a plurality of measurements associated with operation of the well are obtained. For example, the measurements for a cycle, a day, or a couple of days may be obtained. The plurality of measurements may be obtained from the sensors associated with various components of the well (refer FIG. 1). The sensors may communicate with the controller or the SCADA system. Thereafter, at 404, set points for operation of the production valve and the injection valve are determined based on some or all of the plurality of measurements (described in detail in subsequent paragraphs). The set points may be determined by the controller or by the SCADA (and in turn communicated to the controller). Also, the determination of the set points may be based on the data pertaining to a current cycle, the last two cycles or multiple cycles (e.g. measurements of a day or two days or more). Optionally, at 406, one or more of the set points are modified according to a comparison of current and optimal values of plunger velocity and gas and liquid production (also described in detail in subsequent paragraphs). At 408, the operation of the production valve and the injection valve is coordinated based on the set points and the stage in operation cycle by the controller.

The following description of the five parts (i.e. Part-1 to 5) provides an example of how various decisions regarding opening and closing of the production valve and the injection valve may be taken.

Part-1: Decision for Operating Production Valve: Condition for Valve Opening

After the production valve is closed, the controller determines the amount of time required for the plunger to reach the bottom. During this time, the production valve is not opened. In the prior art methods, the opening of production valve is dictated by the event of the casing pressure increasing beyond the so called Foss and Gaul Pressure ($P_{c,max}$), given by:

$$P_{c,min} = (P_W + P_C V_s + P_{line})\left(1 + \frac{H}{K}\right)$$

$$P_{c,max} = \frac{A_a + A_t}{A_a} P_{c,min}$$

In the above equations, $P_W$ is the pressure required to counter the plunger weight; $P_C=(P_{wt}+P_{fric})$ is the pressure (due to slug weight and friction) to lift one barrel of fluid; $P_{line}$ is the line pressure; H is the height of the well, K is the correction for gas friction; and $A_t$ and $A_a$ are cross sectional areas of tubing and annulus, respectively. This is derived for plunger lift system only and assumes zero gas injection.

The above formulation does not account for the effect of injected gas during the plunger arrival, it provides and over estimate of pressure required for a GAPL operation.

The invention includes the effect of injected gas during plunger rise to obtain a better estimate of threshold pressure. This includes the following changes to the above:

Prediction of gas injected during plunger rise.

Calculating effect of injected gas on plunger velocity.

Adjusting the casing pressure required to begin plunger rise cycle

Accordingly, the threshold for casing pressure is calculated using:

$$P_{FG,new} = \frac{A_a + A_t}{A_a} P_{c,min} - P_{input}$$

Here, $P_{input}$ accounts for the effect of gas injected during plunger rise. Note that the effect of pre-charge is already reflected in the current value of casing pressure; hence only the effect of gas injected during plunger rise is accounted for in the above formulation.

$P_{input}$ can be computed from the gas injected in the previous cycles using:

$$Q_{inj}=\int_{t=open}^{t=arrive} F_{inj}\,dt$$

Here, $Q_{inj}$ is in standard cubic meters per second. This is used in:

$$P_{input} = \frac{Q_{inj} \times 44.64}{A_{ann} \times \text{Depth}}$$

This provides very valuable information to the practitioner of GAPL by helping them understand the role of various components in the calculation of threshold pressure. Optionally, the user can be provided with a method to choose these corrections. For example, the user can be provided with a tabular display as shown in FIG. 6.

The last column in the tabular display of FIG. 6 shows the correction due to gas assist, based on previous cycle.

Part 2: Gas Injection Set-Point During Arrival—Arrival Assist.

An improvement to the above can take into account the prediction of how casing pressure will vary in the future plunger rise cycle. For this, the starting point is $P_{FG,new}$ and the end point is $$P_{FG,new}\left(\frac{A_{ann}}{A_{ann} + A_{tub}}\right).$$

Assume the value decreases linearly in time $t_{arr}=H/v_{plunger}$ (where, H is the well depth and $v_{plunger}$ is target plunger speed). Then, one can calculate:

$$Q_{inj} = \frac{\int_{t=0}^{Arr} C_v \sqrt{P_{inj} - P_C}\, dt}{44.64 \times M_{wt}}$$

In the above equation, $C_v$ is the injection valve co-efficient at a given opening, $P_{inj}$ is the injection pressure and $P_C$ is the casing pressure varying as described above. Only the effect of injected gas from opening of production valve (at t=0) till the plunger arrival time is included in the above. Here, the injection pressure can also be assumed to be a constant and accordingly, the calculation only considers variation of the casing pressure.

The $Q_{inj}$ calculated above can be provided as the set-point for an injection sub-controller to negate the effect of fluctuation/disturbance in $P_{inj}$. Therefore, providing a method for set-point calculation of injected gas which will decide the injection valve opening.

Part-3: Decision on Gas Injection During Valve Close (Pre-Charge)

In order to assist the casing pressure to reach the $P_{FG,new}$, gas injection might be needed during the build-up phase of the cycle. However, injecting during build up increases the well-bottom hole pressure and the injected gas can also increase the tubing pressure. Both these conditions are counterproductive and should be minimized.

The key idea of setting injection flow set-point is to avoid the over-injection of gas during shut-in and reject the disturbances from injection pressure fluctuations. The gas can be injected at user defined flowrate $Q_{sp}$. However, if the desired flow-rate results in over injection i.e. more than needed gas is injected in casing, it should be detected and the desired flow set-point $Q_{sp}$ be reduced. One way to detect the over injection is to verify that during the injection period following is satisfied:

$$\Delta P_c < \Delta P_t$$

Here, $\Delta P_c$ is the change in casing pressure and $\Delta P_t$ is the change in tubing pressure w.r.t. time. The condition ensures that there is no short circuit between casing and tubing. It implies that the injected gas is used to raise the pressure on the plunger assist side and not on the plunger back-pressure side.

Part-4: Decision for Operating Production Valve Close

After the production valve is opened, the controller waits for plunger to arrive in the catcher. Only during the after-flow stage the controller takes a decision to close the control valve. The controller may take the decision by calculating Turner Flow Rate given by:

$$Q_{Turner} = A_t v_t$$

In the above, $$v_t = 5.321 \frac{(67 - 0.0043\gamma P/Z)^{0.25}}{(0.0043\gamma P/Z)^{0.5}}$$

The controller closes the production valve when the measured flow rate falls below this threshold value.

Part-5: Calculation of Target Arrival Velocity and GLR for Maximum Production

A rule of thumb to calculate the minimum GLR required to run the plunger lifted well is reported as 400 standard cubic feet per barrel (scf/bbl) per 1000 feet (ft) of well depth. This is minimum GLR required and not necessary the optimal. Similarly, an operating velocity is specified by plunger suppliers typically around 750 feet per minute (ft/min) The total gas liquid ratio (GLR) is defined as:

$$GLR = \frac{\text{Total gas production}}{\text{Total liquid production}}$$

Here, total gas production includes the gas from reservoir as well as the injected gas returning back from the well.

The average plunger arrival velocity is defined as:

$$V = \frac{\text{Depth of well}}{\text{Time of arrival} - \text{Time of valve open}}$$

The initial target can be set using the GLR and target velocity mentioned above. The values provide a good feasible start. Further, the values can be refined based on the maximization of net production according to:

$$\max_{GLR,V} J = -C_1 \cdot F_c \pm C_2 \cdot F_g \pm C_3 \cdot L$$

s.t.

$$GLR_{min} \le GLR \le GLR_{max};$$

$$V_{min} \le V \le V_{max};$$

$$F_c \ge 0;\ F_g \ge 0;\ L \ge 0;\ \text{and}$$

$$C_i \ge 0,\ \forall\, i \in \{1, 2, 3\}.$$

In the above, the following costs are assumed:

1) Cost ($C_1$) of compressed gas ($F_c$)

2) Cost ($C_2$) of produced gas ($F_g$)

3) Cost ($C_3$) of produced liquid (L)

The optimization problem is subjected to the operating data and calculates the best stable operating cycle based on the optimization objective. The corresponding decision variables indicate the optimal feasible set-points. The positive and negative sign indicate the income and cost respectively. Compressed gas is always as cost, produced gas is mostly income however, due to flaring regulations can be cost at times and hydrocarbon liquid are income but water acts as cost. With minimum GLR as from rule of thumb and maximum GLR from surface facility constraint. Similarly minimum and maximum velocity for feasible plunger cycles with no equipment damage is specified by plunger vendors.

Figure 5:
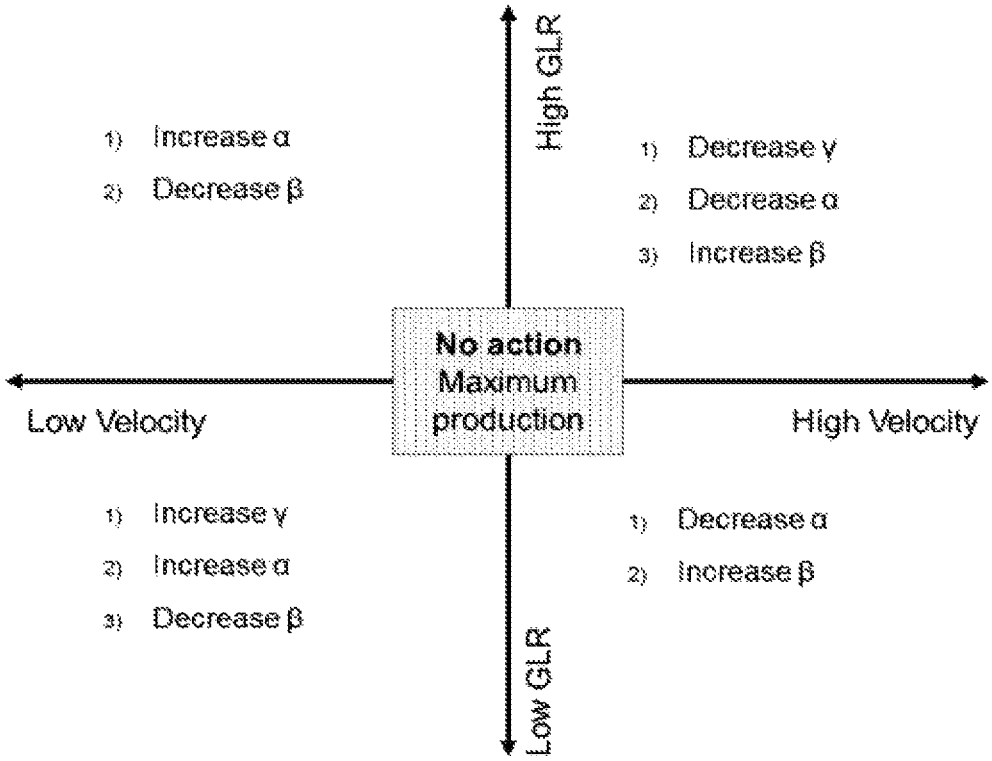
FIG. 5 illustrates a coordination matrix for use in maximizing production of the well.

The following provides an example of how the set points can be adjusted. The matrix illustrated in FIG. 5 is used to tune the controller and change the threshold values of the production valve close, α, production valve open, β, and Injection flow set-point, γ.

To illustrate the operating logic consider an example below. Say: α=1, γ=1, β=1, Velocity set-point is 750 ft/m, and GLR set-point is 10000 scf/bbl. Now, the current cycle shows the velocity of 900 ft/m and GLR of 8000 scf/bbl. This means the current cycle belongs to lower right quadrant of the matrix. The possible actions to take are: Δβ=0.1; Δα=−0.1 or both. The action will result in pushing the next cycle towards the center of the matrix.

The above description is representative of how to manipulate the tuning variables α, γ and β. Instead of using the parameter α, γ and β, the same result can also be achieved by manipulation of the threshold/set-point values for parameters such as time, flow rate, pressure or a combination thereof.

In accordance with the description of the parts-1 to 5 above, the invention defines a variable $\alpha_k$ that modifies the value of $Q_{Turner}$ as:

$$Q_{threshold}=\alpha_k Q_{Turner}$$

The calculation of $\alpha_T$ is based on the convergence of flow rate target and gas liquid ratio (GLR) target (see FIG. 5). Based on these past values, the value of increment, $\Delta\alpha_T$ is computed using steepest gradient method. The next value is then calculated as: $\alpha_{k+1}=\alpha_k+\Delta\alpha_k$.

Further, a co-ordinate parameter β is multiplied with the calculated threshold value of casing pressure $P_{th}=\beta*P_{FG,new}$. Where, $\beta_{k+1}=\beta_k+\Delta\beta_k$ and Δβ is calculated from co-ordination matrix shown in FIG. 5.

Further, the $Q_{inj}$ can be refined based on the plunger velocity set-point as:

$$Q_{inj}=\gamma*Q_{inj,k}$$

where, γ is a tuning factor whose value is obtained using the co-ordination matrix shown in FIG. 5. $\gamma_{k+1}=\gamma_k+\Delta\gamma_k$ where $\Delta\gamma_k$ is calculated based on the current quadrant of the coordination matrix.

The controller and control method for GAPL operation described herein may be implemented using a remote terminal unit (RTU). The controller may also be implemented as a part of Distributed Control system (DCS) or any other control system environment. The controller described herein is configured to advantageously control the production valve open/close condition to maximize the net production/profit, and injection valve opening to ensure normal plunger arrival. Additionally, the invention also explicitly accounts for the fact that the injected gas affects net production/profit, and duration of shut-in/flowing times affect plunger arrival times.

The described embodiments may be implemented as a system, method, apparatus or non transitory article of manufacture using standard programming and engineering techniques related to software, firmware, hardware, or any combination thereof. The described operations may be implemented as code maintained in a "non-transitory computer readable medium", where a processor may read and execute the code from the computer readable medium. The "article of manufacture" comprises computer readable medium, hardware logic, or transmission signals in which code may be implemented. Of course, those skilled in the art will recognize that many modifications may be made to this configuration without departing from the scope of the present invention, and that the article of manufacture may comprise suitable information bearing medium known in the art.

A computer program code for carrying out operations or functions or logic or algorithms for aspects of the present invention may be written in any combination of one or more programming languages which are either already in use or may be developed in future on a non transitory memory or any computing device.

The different modules referred herein may use a data storage unit or data storage device which are non transitory in nature. A computer network may be used for allowing interaction between two or more electronic devices or modules, and includes any form of inter/intra enterprise environment such as the world wide web, Local Area Network (LAN), Wide Area Network (WAN), Storage Area Network (SAN) or any form of Intranet, or any industry specific communication environment.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A method for maximizing production of a well, the well comprising a casing connected to a gas injection line, a tubing connected to a sales line, a production valve for controlling supply to the sales line, an injection valve for controlling injection of gas from the gas injection line into the casing, a plunger for assisting in lifting of one or more of a liquid and a gas in the well, wherein the plunger operation is assisted by the injection of gas through the injection valve, the method comprising:

obtaining, by a controller of the well, a plurality of measurements associated with operation of one or more of the production valve, the injection valve, the gas injection line, the sales line, the casing, the tubing, and the plunger, wherein the plurality of measurements are obtained from one or more sensors detecting at least two of casing pressure, tubing pressure, line pressure, production flow rate, arrival of the plunger in a catcher, injection pressure, and injection flow rate;

determining a set point for opening of the production valve, after closing of the production valve, based on at least one measurement of the plurality of measurements associated with injection of gas through the injection valve and at least one measurement of the plurality of measurements associated with the operation of at least one of the casing, the tubing, the sales line, and the plunger;

determining a set point for operating the injection valve during a period when the production valve is closed based on a comparison of an estimate of a rate of change of pressure in the casing with an estimate of a rate of change of pressure in the tubing, wherein said estimates are based on one or more measurements of the plurality of measurements associated with the operation of the injection valve;

determining a set point for operating the injection valve during a period when the production valve is open based on at least one measurement of the plurality of measurements associated with the operation of at least one of the sales line and the plunger;

determining a set point for closing of the production valve, after opening of the production valve, based on at least one measurement of the plurality of measurements associated with the operation of at least one of the casing, the tubing, and the sales line; and conducting controller operations, by the controller, coordinating operation of each of the production valve and the injection valve to achieve the determined set points based on said determinations and a corresponding stage in an operation cycle of the well, wherein the operation cycle starts and ends with closing of the production valve and comprises the stages of plunger fall, build up, plunger rise, and after flow, wherein one or more of said determinations are performed by at least one of the controller and a Supervisory Control And Data Acquisition (SCADA) system associated with the controller.

2. The method as claimed in claim 1, wherein the set point for opening the production valve is determined based on a measurement of pressure in the casing and an estimate of an amount of gas injection through the injection valve, wherein the estimate is based on a measurement of flow rate of the gas through the injection valve and a time of arrival of the plunger.

3. The method as claimed in claim 2, wherein the estimate of an amount of gas injection through the injection valve includes a prediction of only the amount of gas injection during plunger rise for a subsequent period of the production valve being open.

4. The method as claimed in claim 3, wherein the prediction of only the amount of gas injection during plunger rise for a subsequent period of the production value being open is determined based on an amount of gas injection in one or more previous cycles of the plunger.

5. The method as claimed in claim 1, wherein the set point for operating the injection valve during the period when the production valve is open is determined based on an estimate of the amount of gas injection during plunger rise, wherein the estimate is based on one or more measurements of the plurality of measurements associated with operation of the injection valve.

6. The method as claimed in claim 1, wherein the set point for closing of the production valve is determined based on a measurement of pressure of the tubing and the sales line.

7. The method as claimed in claim 1, further comprising modifying at least one of the set point for opening of the production valve, the set point for operating the injection valve during the period when the production valve is opened, the set point for closing of the production valve, and the set point for operating the injection valve during the period when the production valve is closed, wherein the modification is based on a comparison of a measurement of plunger velocity and gas and liquid production with corresponding optimal values.

8. The method as claimed in claim 1, wherein determining each of the set points for operating the injection valve during the period when the production valve is closed and the period when the production valve is open includes automatically determining the set points.

9. The method as claimed in claim 1, wherein determining each of the set points for opening and closing the production valve includes automatically determining the set points.

10. A system for maximizing production of a well, the well comprising a casing connected to a gas injection line, a tubing connected to a sales line, a production valve for controlling supply to the sales line, an injection valve for controlling injection of gas from the gas injection line into the casing, a plunger for assisting in lifting of one or more of a liquid and a gas in the well, wherein the plunger operation is assisted by the injection of gas through the injection valve, the system comprising:

a plurality of sensors for collecting a plurality of measurements associated with operation of one or more of the production valve, the injection valve, the gas injection line, the sales line, the casing, the tubing, and the plunger, wherein the plurality of sensors are configured to detect at least two of casing pressure, tubing pressure, line pressure, production flow rate, arrival of the plunger in a catcher, injection pressure, and injection flow rate;

a controller configured to conduct controller operations coordinating operation of each of the production valve and the injection valve in an operation cycle comprising the stages of plunger fall, build up, plunger rise, and after flow, wherein the controller operations coordinate operation of each of the production valve and the injection valve to achieve:

a set point for opening of the production valve, determined based on at least one measurement of the plurality of measurements associated with injection of gas through the injection valve and at least one measurement of the plurality of measurements associated with operation of at least one of the casing, the tubing, the sale line, and the plunger;

a set point for operating the injection valve during a period when the production valve is closed, determined based on a comparison of an estimate of a rate of change of pressure in the casing with an estimate of a rate of change of pressure in the tubing, wherein said estimates are based on one or more measurements of the plurality of measurements associated with the operation of the injection valve;

a set point for operating the injection valve during a period when the production valve is open, determined based on at least one measurement of the plurality of measurements associated with the operation of at least one of the sales line and the plunger; and a set point for closing of the production valve, determined based on at least one measurement of the plurality of measurements associated with the operation of at least one of the casing, the tubing, and the sales line;

wherein one or more of said set points are determined by at least one of the controller and a Supervisory Control And Data Acquisition (SCADA) system associated with the controller based on one or more of the plurality of measurements from the plurality of sensors.

11. The system as claimed in claim 10, wherein the set point for opening the production valve is determined based on a measurement of pressure in the casing and an estimate of an amount of gas injection through the injection valve, wherein the estimate is based on a measurement of flow rate of the gas through the injection valve and a time of arrival of the plunger.

12. The system as claimed in claim 11, wherein the estimate of an amount of gas injection through the injection valve includes a prediction of only the amount of gas injection during plunger rise for a subsequent period of the production valve being open.

13. The system as claimed in claim 12, wherein the prediction of only the amount of gas injection during plunger rise for a subsequent period of the production value being open is determined based on an amount of gas injection in one or more previous cycles of the plunger.

14. The system as claimed in claim 10, the set point for operating the injection valve during the period when the production valve is open is determined based on an estimate of the amount of gas injection during plunger rise, wherein the estimate is based on one or more measurements of the plurality of measurements associated with operation of the injection valve.

15. The system as claimed in claim 10, wherein the set point for closing of the production valve is determined based on a measurement of pressure of the tubing and the sales line.

16. The system as claimed in claim 10, wherein the controller is configured to modify at least one of the set point for opening of the production valve, the set point for operating the injection valve during the period when the production valve is opened, the set point for closing of the production valve, and the set point for operating the injection valve during the period when the production valve is closed, wherein the modification is based on a comparison of a measurement of plunger velocity and gas and liquid production with corresponding optimal values.

17. The system as claimed in claim 10, wherein the controller is configured to automatically determine each of the set points for operating the injection valve during the period when the production valve is closed and during the period when the production valve is open.

18. The system as claimed in claim 10, wherein the controller is configured to automatically determine each of the set points for opening and closing the production valve.

* * * * *